US011076664B1

(12) United States Patent
Podhajny et al.

(10) Patent No.: US 11,076,664 B1
(45) Date of Patent: Aug. 3, 2021

(54) FABRIC CASES FOR ELECTRONIC DEVICES

(71) Applicant: Apple Inc., Cupertino, CA (US)

(72) Inventors: Daniel A. Podhajny, San Jose, CA (US); Kathryn P. Crews, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 682 days.

(21) Appl. No.: 15/816,248

(22) Filed: Nov. 17, 2017

Related U.S. Application Data

(63) Continuation of application No. 14/861,625, filed on Sep. 22, 2015, now abandoned.

(60) Provisional application No. 62/053,731, filed on Sep. 22, 2014.

(51) Int. Cl.
*A45C 11/00* (2006.01)
*D03D 25/00* (2006.01)
*D03D 41/00* (2006.01)

(52) U.S. Cl.
CPC ..... *A45C 11/00* (2013.01); *D03D 25/005* (2013.01); *D03D 41/00* (2013.01); *A45C 2011/002* (2013.01); *A45C 2011/003* (2013.01); *A45F 2200/0516* (2013.01); *A45F 2200/0525* (2013.01)

(58) Field of Classification Search
CPC ..... A45C 2011/001; A45C 2011/002; A45C 2011/003; A45F 2200/0508; A45F 2200/0516; A45F 2200/0525; D03D 25/005
USPC ..... 442/203
See application file for complete search history.

(56) References Cited

U.S. PATENT DOCUMENTS

| | | | | |
|---|---|---|---|---|
| 3,837,368 | A | 9/1974 | Budzyna | |
| 4,572,244 | A | 2/1986 | Kojima et al. | |
| 4,850,399 | A | 7/1989 | Linka et al. | |
| 4,916,783 | A | 4/1990 | Hagewood et al. | |
| 5,002,184 | A | 3/1991 | Lloyd | |
| 5,078,384 | A | 1/1992 | Moore | |
| 5,085,252 | A | 2/1992 | Mohamed et al. | |
| 5,242,745 | A * | 9/1993 | Aucagne | D03D 3/08 139/11 |
| 5,295,516 | A | 3/1994 | Tanaka et al. | |

(Continued)

FOREIGN PATENT DOCUMENTS

| | | | | |
|---|---|---|---|---|
| EP | 2594153 | A1 * | 5/2013 | A45C 11/00 |
| FR | 2490687 | A1 * | 3/1982 | D03D 13/00 |

*Primary Examiner* — Allan D Stevens
(74) *Attorney, Agent, or Firm* — Treyz Law Group, P.C.; G. Victor Treyz; Matthew R. Williams

(57) ABSTRACT

Fabric may be woven using a needle weaving machine. The needle weaving machine may have three weft fiber needles and two hooks for holding weft fibers from the weft fiber needles. One of the weft fiber needles may provide weft fibers to multiple hooks when weaving fabric with warp fibers held in a V-shaped profile. An electronic device may have a rectangular footprint with four curved corners. A length of fabric may be woven to form a case having four curved corners that match the four curved corners of the electronic device. The case may have a C-shaped profile with parallel upper and lower fabric portions coupled by a sidewall. Short rows of weft fiber may be used around the corners of the case to ensure that the upper and lower portions of the fabric lie flush with planar front and rear surfaces of the electronic device.

18 Claims, 11 Drawing Sheets

(56) References Cited

U.S. PATENT DOCUMENTS 5,322,273 A 6/1994 Rapkin et al.
5,327,939 A 7/1994 Burgess
5,360,108 A 11/1994 Alagia
5,465,760 A 11/1995 Mohamed et al.
5,508,775 A 4/1996 Mizuno
5,558,440 A 9/1996 Miller
5,771,793 A 6/1998 Kayser
6,431,220 B1 8/2002 Nakada
6,470,916 B1 10/2002 Uchida et al.
6,646,864 B2 11/2003 Richardson
6,886,603 B2 5/2005 Uchida et al.
6,951,178 B2 10/2005 Watts
7,230,823 B2 6/2007 Richardson et al.
7,312,984 B2 12/2007 Richardson et al.
7,490,721 B2 2/2009 Bishop
7,609,512 B2 10/2009 Richardson et al.
7,663,879 B2 2/2010 Richardson et al.
7,907,394 B2 3/2011 Richardson et al.
D640,679 S 6/2011 Willes et al.
8,204,561 B2 6/2012 Mongan et al.
8,215,855 B2 7/2012 Jacobsen et al.
8,389,424 B2 * 3/2013 Goering ..... B29C 70/22 442/203
8,443,971 B1 5/2013 Green et al.
8,486,517 B2 * 7/2013 Crawford, Jr. ..... D04B 21/20 428/222
8,509,865 B1 8/2013 LaColla et al.
8,545,966 B2 10/2013 Vito et al.
8,706,176 B1 4/2014 Jia et al.
D707,217 S 6/2014 Touotte
8,944,614 B2 2/2015 Parrill
8,960,427 B2 2/2015 Green et al.
9,124,680 B2 9/2015 Lundell
9,160,824 B2 10/2015 Torset et al.
9,408,446 B2 8/2016 Liebers et al.
9,456,066 B2 9/2016 Singhal
9,496,909 B2 11/2016 West
9,588,551 B1 3/2017 Hegde et al.
9,729,186 B1 8/2017 Dill
2002/0059962 A1 5/2002 Nakada et al.
2004/0181200 A1 9/2004 Desai et al.
2006/0243842 A1 11/2006 Saldana
2007/0228099 A1 10/2007 Beda
2008/0166532 A1 7/2008 Tsiarkezos
2009/0025544 A1 1/2009 Mohamed
2009/0080153 A1 3/2009 Richardson et al.
2010/0043908 A1 2/2010 Mohamed
2011/0111664 A1 * 5/2011 Goering ..... B29C 70/222 442/181
2011/0210018 A1 9/2011 Friedman et al.
2011/0240213 A1 10/2011 Barlag et al.
2011/0275266 A1 * 11/2011 Lecostaouec ..... F16D 69/023 442/240
2011/0303560 A1 12/2011 Friedman et al.
2012/0031788 A1 2/2012 Mongan et al.
2012/0194982 A1 8/2012 Hishida
2012/0244918 A1 * 9/2012 Hall ..... H04B 1/3888 455/575.4
2012/0251793 A1 * 10/2012 Goering ..... B29B 11/16 428/192
2012/0261289 A1 10/2012 Wyner et al.
2013/0092562 A1 4/2013 Wyner et al.
2013/0111962 A1 5/2013 Noe
2013/0137327 A1 * 5/2013 Tseng ..... H04B 1/08 442/229
2013/0140195 A1 * 6/2013 Law ..... A45C 11/00 206/45.24
2013/0147330 A1 6/2013 DiFonzo
2013/0251973 A1 * 9/2013 Crawford ..... D03D 3/00 428/222
2014/0072759 A1 3/2014 Berg et al.
2014/0150922 A1 * 6/2014 Lecostaouec ..... D03D 1/00 139/420 R
2014/0252786 A1 9/2014 Singhal
2015/0151515 A1 6/2015 Skepton
2015/0313003 A1 10/2015 Kasar
2015/0342307 A1 12/2015 Weber et al.
2016/0230929 A9 8/2016 Singhal
2016/0277055 A1 9/2016 Lechner
2017/0060190 A1 3/2017 Hedge et al.
2017/0069442 A1 3/2017 Wang et al.
2017/0090515 A1 3/2017 Stevick
2017/0202345 A1 7/2017 Hall

* cited by examiner

FABRIC CASES FOR ELECTRONIC DEVICES

This application is a continuation of patent application Ser. No. 14/861,625, filed Sep. 22, 2015, which claims the benefit of provisional patent application No. 62/053,731 filed Sep. 22, 2014, both of which are hereby incorporated by reference herein in their entireties.

BACKGROUND

This relates generally to fabric, and, more particularly, to forming fabric for structures such as cases for electronic devices.

Electronic devices such as cellular telephones, computers, and other electronic equipment are sometimes used in conjunction with external cases. A user may, for example, place an electronic device in a removable plastic case to protect the electronic device from scratches. Removable cases may also be used to personalize electronic devices.

Plastic cases may be satisfactory in certain situations, but some users may desire a case with different aesthetics. As a result, fabric cases have been developed.

There are challenges associated with forming fabric cases for electronic devices. If care is not taken, fabric cases may not wear well, may be bulky, or may have an undesirable appearance.

It would therefore be desirable to be able to provide improved removable cases for electronic devices.

SUMMARY

Fabric may be woven to form a removable case for an electronic device or other fabric structures. The fabric may be woven using a needle weaving machine. The needle weaving machine may have three weft fiber needles and two hooks for holding weft fibers from the weft fiber needles. One of the weft fiber needles may provide weft fibers to both of the hooks when weaving fabric with warp fibers held in a V-shaped profile. Fabric from the needle weaving machine may be received within a take down system that has one or more rollers formed from individually controllable rotating disks.

An electronic device may have a rectangular footprint with four curved corners. A length of fabric may be woven to form a case having four curved corners that match the four curved corners of the electronic device. The case may have a C-shaped profile with parallel upper and lower fabric portions coupled by a vertical sidewall. Short rows of weft fiber may be woven into corner portions of the upper and lower fabric portions of the case to ensure that the upper and lower portions of the fabric lie flush with planar front and rear surfaces of the electronic device.

DETAILED DESCRIPTION

Electronic devices may be provided with cases such as fabric cases. The fabric cases may be removable external cases. When a user desires to protect an electronic device from scratches or other damage, the user may place an electronic device within a case. When the user wishes to use a different case to change the appearance of an electronic device, the electronic device may be transferred from one case to another. If desired, fabric may be incorporated into an electronic device housing or may be used in forming other fabric-based structures. Arrangements in which fabric is used in forming removable external cases are sometimes described herein as an example.

The fabric for a removable case may be woven, knitted, or braided, or may be formed using other fiber intertwining techniques. For example, fabric can be woven using a needle weaving machine.

Figure 1:
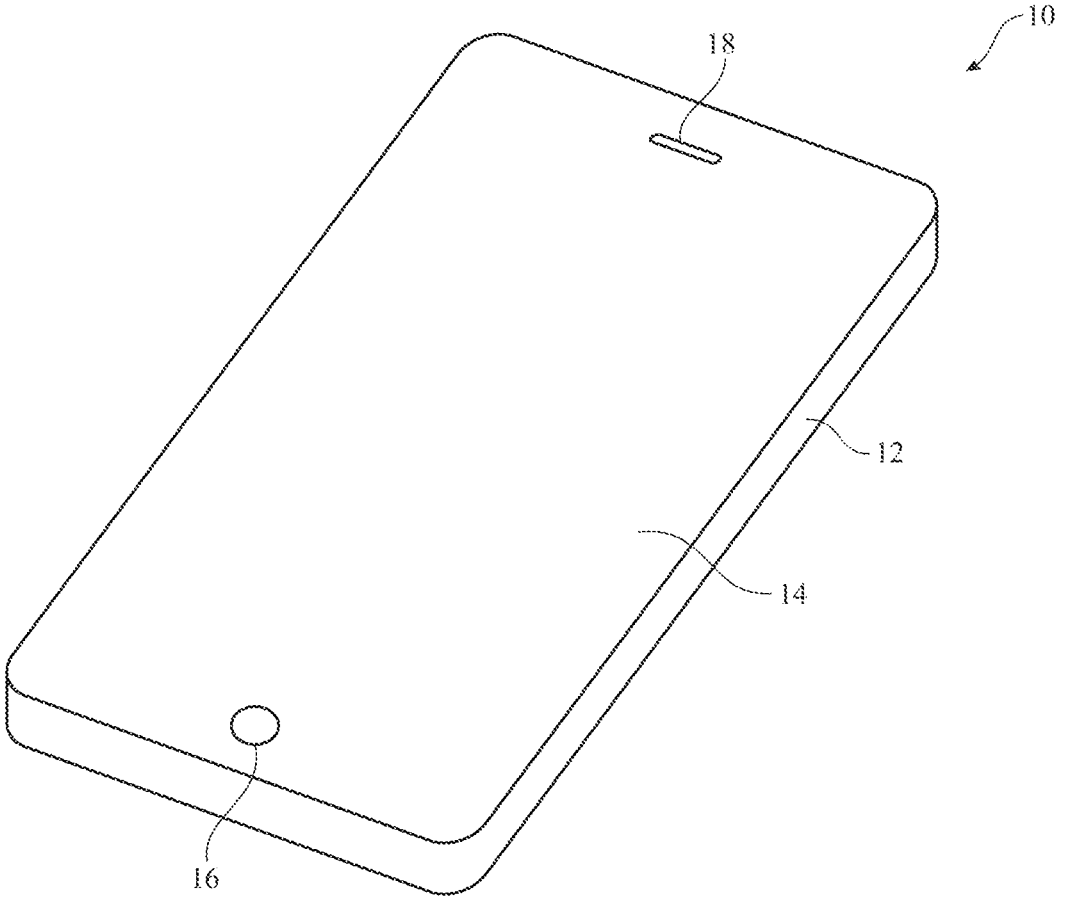
FIG. 1 is a perspective view of an illustrative electronic device in accordance with an embodiment.

An electronic device of the type that may be provided with a removable case that has been woven using a needle weaving machine is shown in FIG. 1. In the example of FIG. 1, device 10 includes a display such as display 14 mounted in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Display 14 may include an array of pixels formed from liquid crystal display (LCD) components, an array of electrophoretic pixels, an array of plasma pixels, an array of organic light-emitting diode pixels or other light-emitting diodes, an array of electrowetting pixels, or pixels based on other display technologies.

Display 14 may be protected using a display cover layer such as a layer of transparent glass or clear plastic. The display cover layer may form a planar front face for device 10. The rear of housing 12 may have a parallel planar surface. Housing sidewalls may run around the periphery of housing 12. Device 10 may have a rectangular outline (e.g., a rectangular footprint when viewing the front face of the device) or may have other suitable footprints.

Openings may be formed in the display cover layer. For example, an opening may be formed in the display cover layer to accommodate a button such as button 16. An opening may also be formed in the display cover layer to accommodate ports such as speaker port 18. Openings may be formed in housing 12 to form communications ports (e.g., an audio jack port, a digital data port, etc.), to form openings for buttons, etc.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

Figure 2:
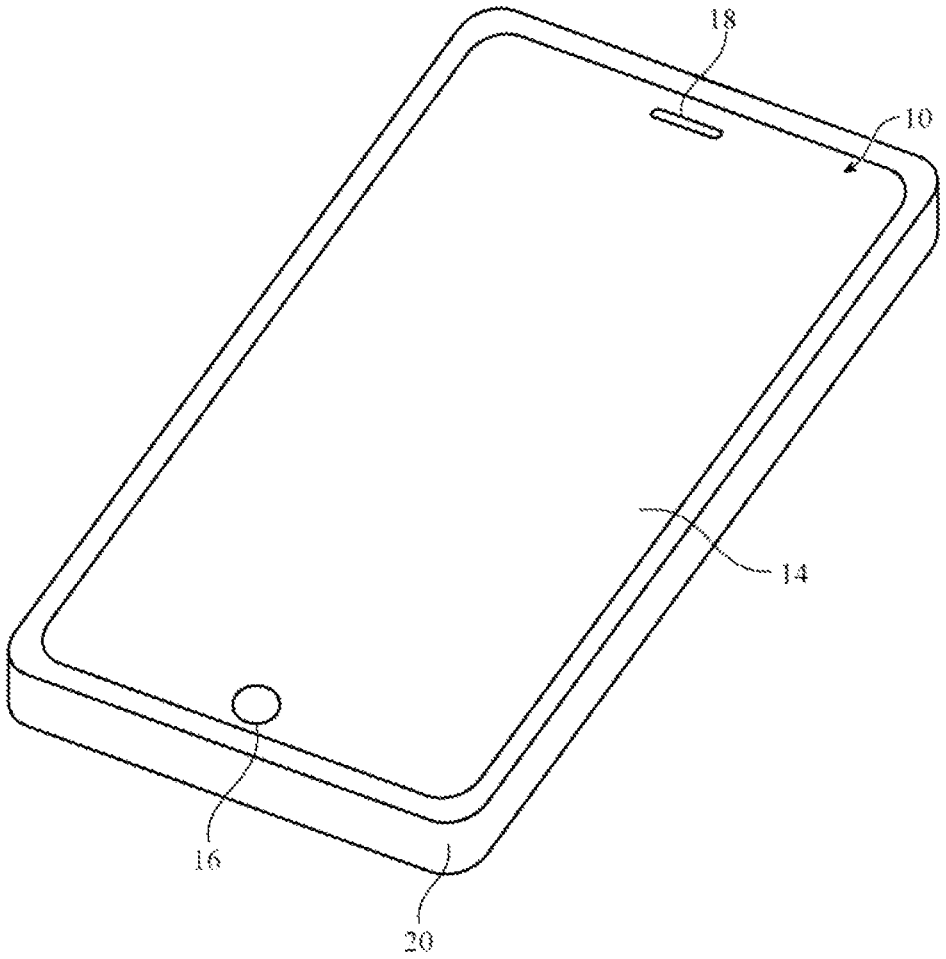
FIG. 2 is a perspective view of an illustrative electronic device to which a removable case has been attached in accordance with an embodiment.

FIG. 2 is a perspective view of device 10 of FIG. 1 in a configuration in which device 10 has been mounted in a removable case. As shown in FIG. 2, removable case 20 may have walls that run around the periphery of device 10. If desired, case 20 may form a cover with a hinged portion, a structure with a pocket into which device 10 may slide, or other enclosure that receives device 10. In the example of FIG. 2, case 20 surrounds device 10, but does not cover display 14. This type of arrangement, which may be desirable for devices such as cellular telephones, watches, and tablet computers, allows display 14 to be viewed by a user without opening a cover flap or moving any portion of case 20. If desired, however, case 20 may be provided with pockets, flaps, hinged portions, straps, and other structures. The configuration of FIG. 2 is merely illustrative.

Figure 3:
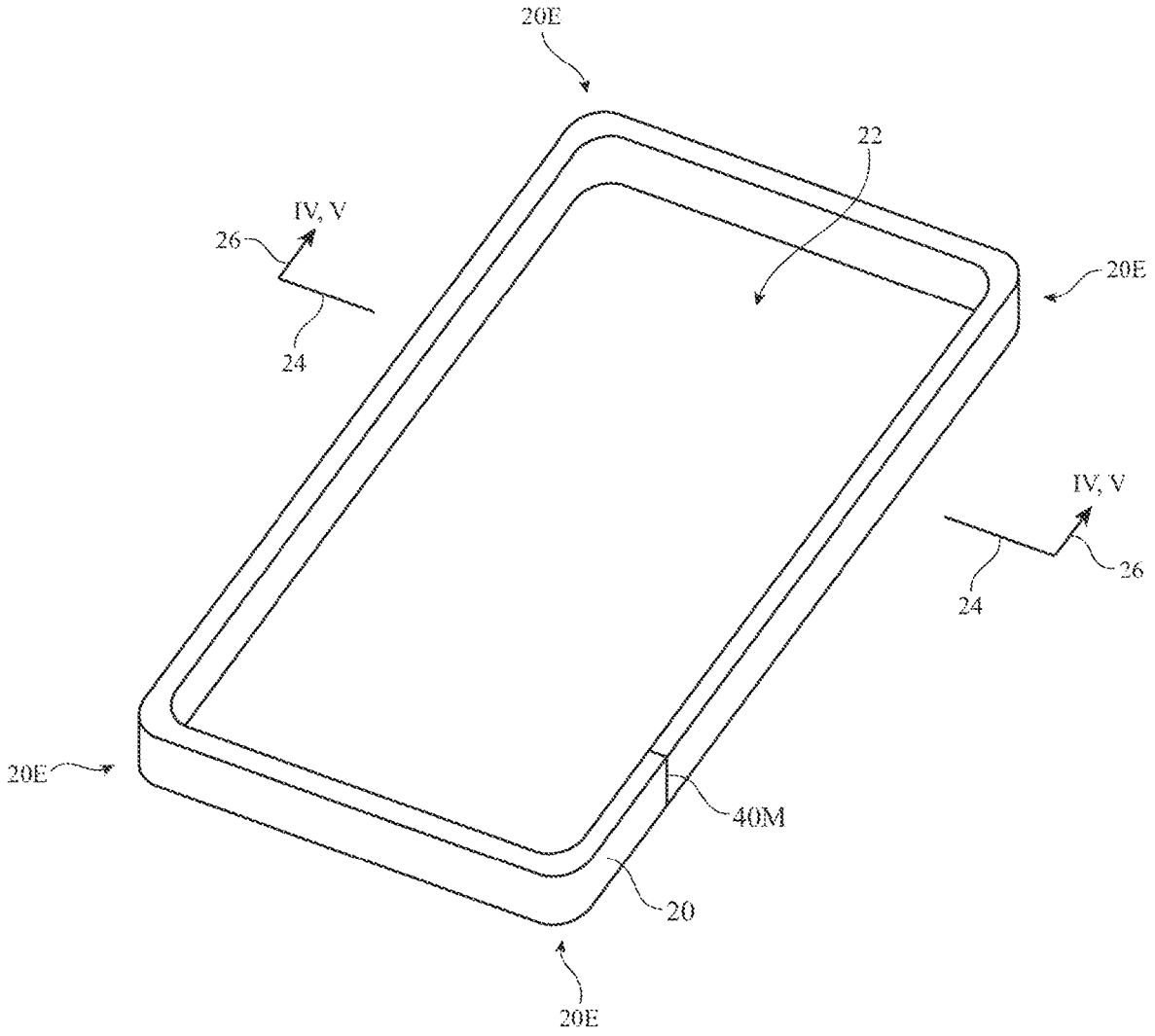
FIG. 3 is s perspective view of an illustrative removable electronic device case in accordance with an embodiment.

FIG. 3 is a perspective view of case 20 of FIG. 2 in a configuration in which device 10 is not present (i.e., a configuration in which case 20 has been removed from device 10). As shown in FIG. 3, case 20 may have four straight segments each of which runs along and covers a respective one of the four straight peripheral edges of the rectangular housing of device 10. Corner portions of the case join the straight segments together to form a case with a rectangular ring shape. Corners 20E may be rounded when viewed from above (i.e., when case 20 has a footprint with rounded corners) or may have other shapes. Central opening 22 may have a rectangular shape (e.g., a rectangular shape with rounded corners) or other shape suitable for receiving electronic device 10 when electronic device 10 is mounted within case 20.

Figure 4:
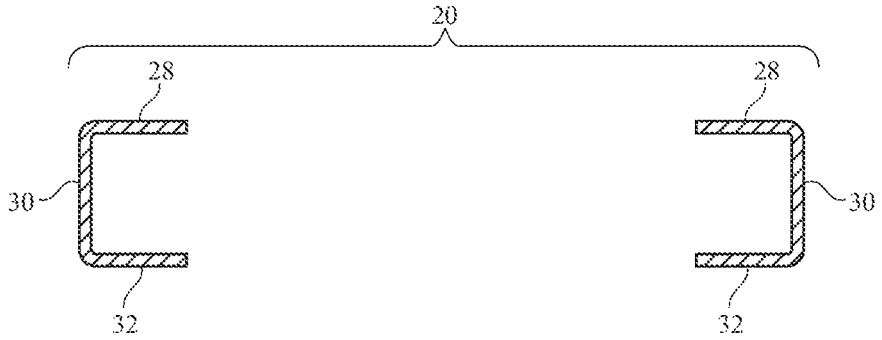
FIG. 4 is a cross-sectional view taken along line 24, also labeled as IV-IV, and viewed in direction 26 of a removable case with peripheral walls surrounding a central opening in accordance with an embodiment.

A cross-sectional view of case 20 of FIG. 3 taken along line 24 and viewed in direction 26 is shown in FIG. 3. As shown in FIG. 3, case 20 may have sidewalls such as vertical fabric sidewalls 30 that join respective upper horizontal wall portion 28 and lower horizontal wall portion 32. This forms a C-shaped channel that runs around the periphery of device 10 when device 10 is installed within case 20. The rectangular C-shaped cross-sectional shape of case 20 of FIG. 4 (i.e., the shape in which upper and lower horizontal wall portions 28 and 32 lie in planes that are parallel to each other and that are perpendicular to the plane of vertical fabric sidewall 30) is merely illustrative. If, for example, device 10 has edges with a curved cross-sectional shape, the C-shaped profile of case 20 may have a correspondingly curved shape (e.g., vertical fabric sidewall 30 may bow outwards). Moreover, the fabric of case 20 may be formed from fibers that are elastic to accommodate devices 10 with a variety of different edge profiles and footprints. The example of FIGS. 3 and 4 is merely illustrative.

Figure 5:
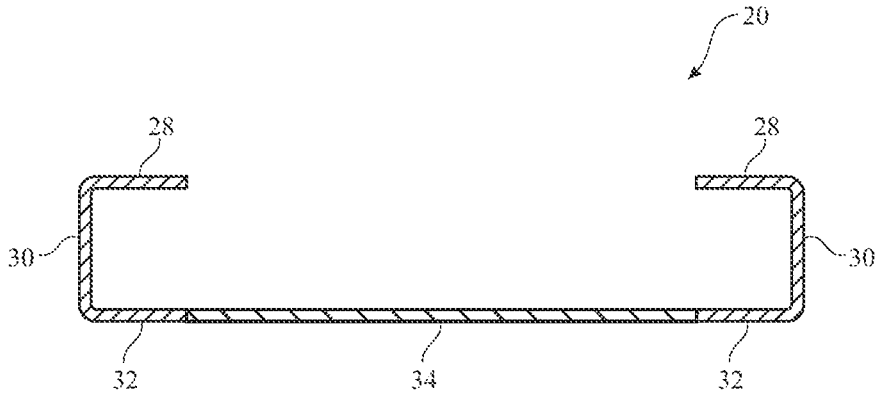
FIG. 5 is a cross-sectional view of a removable case with peripheral walls that surround a rectangular planar rear wall in accordance with an embodiment.

FIG. 5 is a cross-sectional side view of case 20 in a configuration in which rear wall portion 34 has been incorporated into case 20. Rear wall portion 34 may be formed from a layer of plastic or metal or may be formed from a layer of fabric. Rear wall portion 34 may cover some or all of the rear of device 10 and may be attached to lower horizontal wall portions 32 or woven or formed as an integral portion of lower horizontal wall portions 32.

Figure 6:
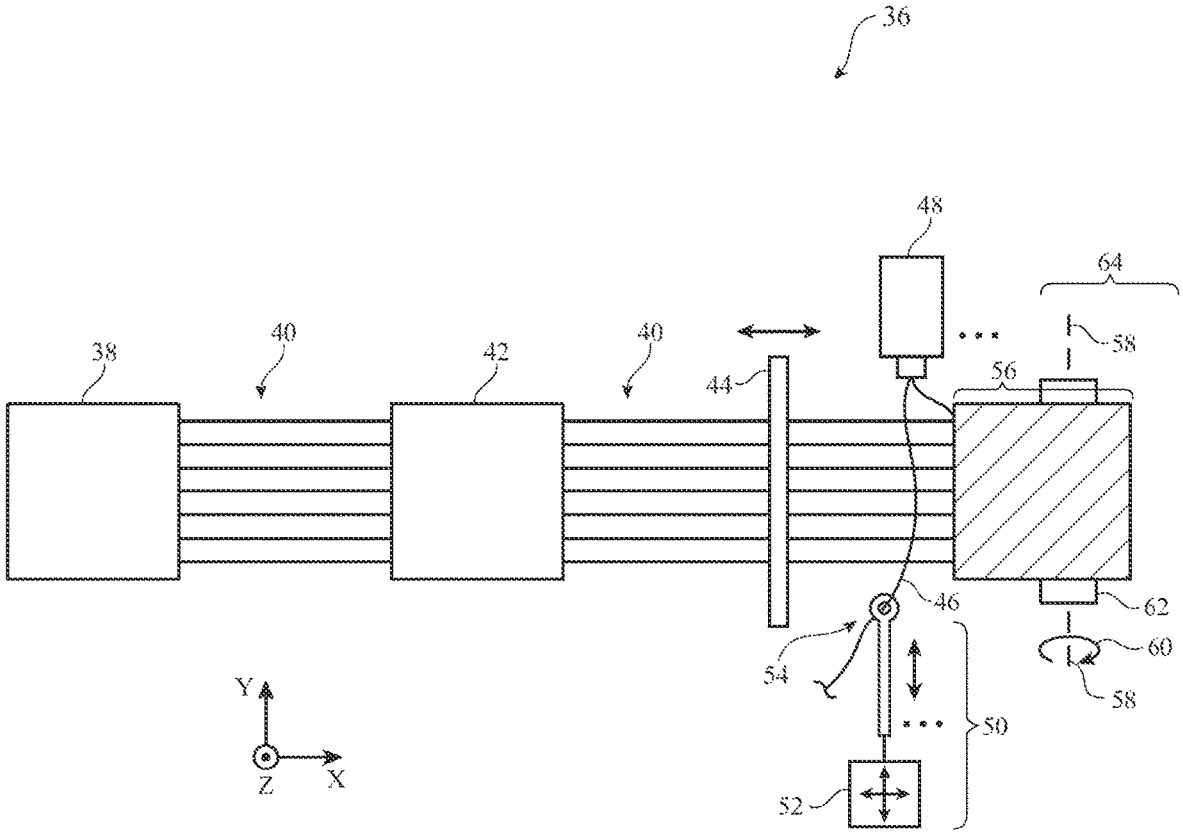
FIG. 6 is a top view of illustrative needle weaving equipment of the type that may be used in forming fabric for a removable electronic device case or other fabric structures in accordance with an embodiment.

FIG. 6 is a top view of an illustrative needle weaving system of the type that may be used to form woven removable cases such as case 20 and other fabric structures. As shown in FIG. 6, system 36 may be provided with fibers from fiber source 38. Fiber source 38 may include a warping creel. The fibers provided by fiber source 38 may be single-strand filaments or may be threads, yarns, or other fibers that have been formed by intertwining single-strand filaments. Fibers may be formed from polymer, metal, glass, graphite, ceramic, natural materials such as cotton or bamboo, or other organic and/or inorganic materials and combinations of these materials. Conductive coatings such as metal coatings may be formed on non-conductive fiber cores. Fibers may also be formed from single filament metal wire or stranded wire. Fibers may be insulating or conductive. Fibers may be conductive along their entire length or may have conductive segments (e.g., metal portions that are exposed by locally removing polymer insulation from an insulated conductive fiber). Threads and other multi-strand fibers that have been formed from intertwined filaments may contain mixtures of conductive fibers and insulating fibers (e.g., metal fibers or metal coated fibers with or without exterior insulating layers may be used in combination with solid plastic fibers or natural fibers that are insulating).

Fiber source 38 may provide warp fibers 40. Weft fibers 46 may also be supplied to system 36 from a source such as source 38. Weft fibers 46 may be formed from the same materials as warp fibers 40 or may be formed from different materials. During weaving, warp fibers 40 and weft fibers 46 may be woven together to form fabric 56.

Warp fibers 40 may pass through computer-controlled warp fiber positioning equipment 42. Warp fiber positioning equipment 42 may sometimes be referred to as a Jacquard head or Jacquard. During operation, warp fiber positioning equipment 42 may be used to selectively deflect warp fibers 40 in directions such as upwards direction Z and/or downwards direction Z). When being used to form a fabric with a plain weave, for example, warp fiber positioning equipment 42 may deflect even warp fibers 40 upwards while leaving odd fibers in a neutral position to create a temporary vertical space known as a shed between these two sets of warp fibers. Following insertion of a weft thread into the shed formed between the upper and lower warp fibers, a shed change may be performed in which warp fiber positioning equipment 42 places the even warp fibers 40 in a neutral (undeflected) position and deflects odd warp fibers upwards. Individual warp fibers 40 and/or sets of two or more warp fibers 40 can be deflected in this way using warp fiber positioning equipment 42.

During weaving operations, weft fiber positioning equipment 50 may be used to insert weft fiber 46 in the shed between sets of deflected warp fibers 40. Weft fiber positioning equipment 50 may include a computer-controlled positioner such as positioner 52 that positions a weft fiber dispensing structure such as weft fiber needle 54, so weft fiber positioning equipment 50 may sometimes be referred to as a needle.

Needle 54 may be moved across warp fibers 40 (e.g., in directions along dimension Y). Initially, needle 54 moves in direction Y to deliver weft fiber 46 to hook 48. Hook 48 (e.g., a hook and computer-controlled latch mechanism or any other mechanism that can engage weft fiber 46) temporarily holds onto the weft fiber that has been delivered to hook 48 by needle 54. Needle 54 may then be retracted in direction −Y to lay weft fiber 46 across warp fibers 40. After each pass of needle 54 across warp fibers 40, reed 44 may be moved in direction X (and then retracted in in direction −X) to push the weft fiber that has just been inserted though the shed in the warp fibers against previously woven fabric 56, thereby ensuring that a satisfactorily tight weave is produced. Each time reed 44 is retracted, a shed change may be performed, followed by delivery of an additional length of weft fiber 46 by needle 54. Fabric 56 that has been woven in this way may be gathered on take down system 64. Take down system 64 (sometimes referred to as a take down) may have one or more rollers such as roller 62. Roller 62 may rotate about axis 58 in direction 60 to tension warp fibers 40 while gathering fabric 56.

Using the creel of source 38 and warp fiber positioning equipment 42, warp fibers 40 may be positioned into a pattern of the type shown in the cross-sectional view of FIG. 5. In particular, warp fibers 40 may be positioned to form upper horizontal warp fiber portion 40-1, parallel lower horizontal warp fiber portion 40-3, and two intermediate diagonal warp fiber portions 40-2A and 40-2B. Intermediate diagonal warp fiber portions 40-2A and 40-2B form a V-shaped profile that joins upper horizontal warp fiber portion 40-1 to lower horizontal warp fiber portion 40-3. After weaving is complete (i.e., after fabric 56 for case 20 has been woven), upper horizontal warp fiber portion 40-1 will form upper horizontal wall portion 28, intermediate diagonal warp fiber portions 40-2A and 40-2B will be pulled into a planar vertical orientation (i.e., the V-shaped profile will be opened up) and will form vertical fabric sidewall 30, and lower horizontal warp fibers portion 40-3 will form lower horizontal wall portion 32. The warp fibers of the structure of FIG. 7 may all be formed from the same type of fibers or different sections of the warp fibers may be formed from different types of fiber (e.g., the warp fibers and weft fiber used in forming the fabric of intermediate diagonal warp fiber portions 40-2A and 40-2B may be formed from elastic materials to help the sidewall fabric of the V-shaped portion to open up when device 10 is mounted in case 20).

Figure 7:
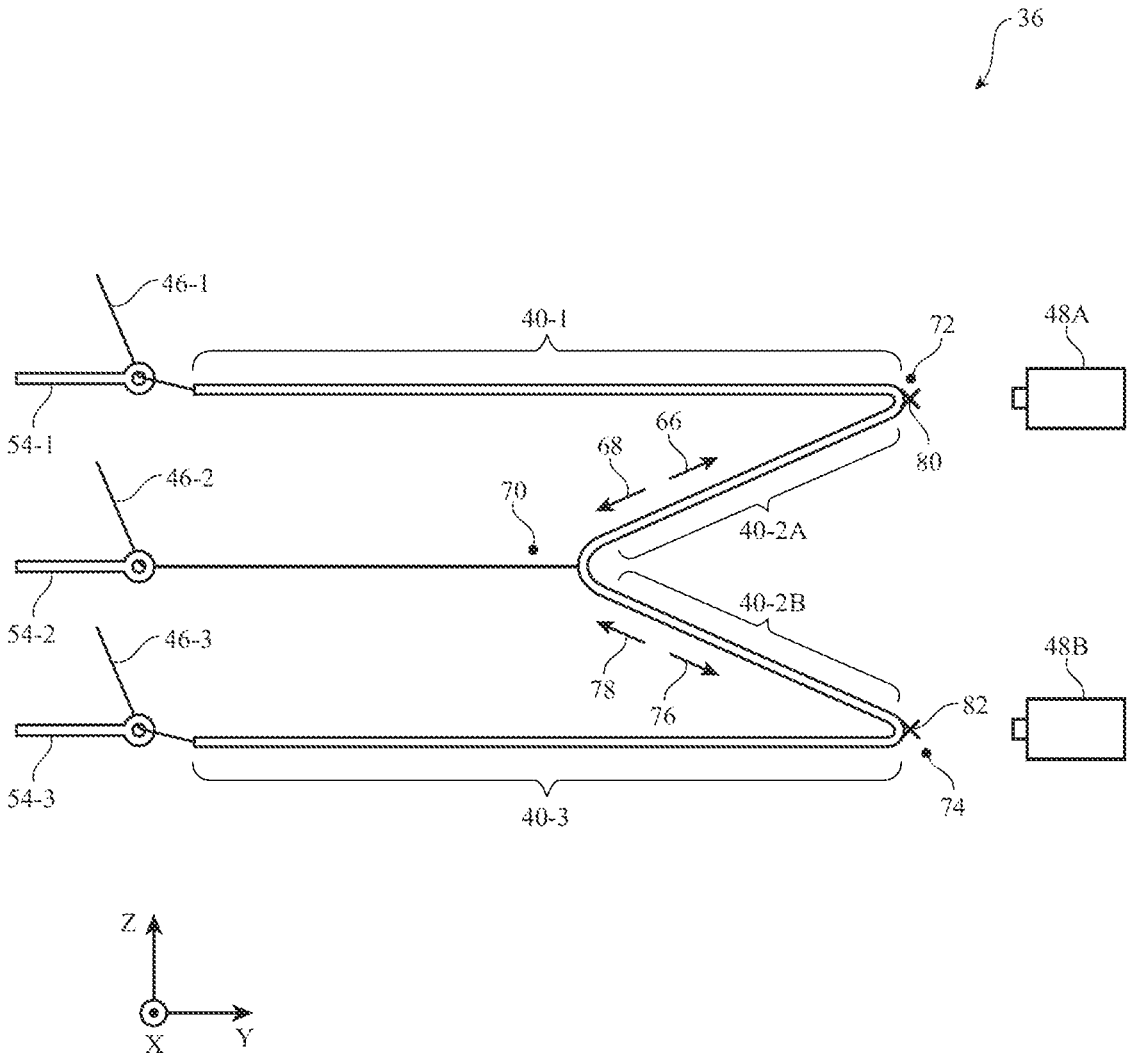
FIG. 7 is a side view of illustrative needle weaving equipment being used to weave an electronic device case in accordance with an embodiment.

When the V-shaped fabric of FIG. 7 opens up to form vertical fabric sidewall 30, upper and lower horizontal wall portions 28 and 32 may lie flush with the upper and lower surfaces of device 10. In a finished version of case 20, opposing ends of fabric 56 will be joined along a seam such as seam 40M of FIG. 3. When device 10 is installed in case 20, the warp fibers in vertical fabric sidewall of case 20 will run along the periphery of device 10 (e.g. parallel to the outermost edge of housing 12).

As shown in FIG. 7, weaving system 36 may have three needles (needles 54-1, 54-2, and 54-3) and two hooks (48A and 48B). Needle 54-1 may be used to dispense weft fiber 46-1, needle 54-2 may be used to dispense weft fiber 46-2, and needle 54-3 may be used to dispense weft fiber 46-3. Hooks 48A and 48B may be used to temporarily hold onto weft fiber that has been moved across the warp fibers by the needles.

Needle 54-1 may move back and forth through a shed defined in upper horizontal warp fiber portion 40-1 along dimension Y during weaving of upper horizontal wall portion 28 of case 20. Hook 48A may be used to temporarily hold weft fiber 46-1 that has been delivered to hook 48A by needle 54-1 during weaving of upper horizontal wall portion 28 from weft fiber 46-1 and upper horizontal warp fiber portion 40-1.

Similarly, needle 54-3 may move back and forth along dimension Y through the shed formed in lower horizontal warp fiber portion 40-3 during weaving of lower horizontal wall portion 32 of case 20. Hook 48B may be used to temporarily hold weft fiber 46-3 that has been delivered to hook 48B by needle 54-1 when weaving of lower horizontal wall portion 32 from weft fiber 46-3 and lower horizontal warp fiber portion 40-3.

Needle 54-2 may pull weft fibers across the V-shaped profile of intermediate diagonal warp fiber portion 40-2A and 40-2B during weaving operations. Initially, needle 54-2 may move to the right in direction 66 to move weft fiber from a position such as position 70 on the left edge of intermediate diagonal warp fiber portion 40-2A to a position on the right of intermediate diagonal warp fiber portion 40-2A such as position 72. Needle 54-2 may then move to the left (direction 68) to move weft fiber 46-2 back across intermediate diagonal warp fiber portion 40-2A. Hook 48A may hold weft fiber 46-2 in position 72, while needle 54-2 is retracted across intermediate diagonal warp fiber portion 40-2A. At this point warp fiber positioning equipment 42 may be used to perform a shed change (i.e., sets of warp fibers may reverse positions to capture the weft). Needle 54-2 may then be used to dispense the weft across intermediate diagonal warp fiber portion 40-2B by moving from position 70 to position 74 (moving to the right in direction 76). Hook 48B may hold weft fiber 46-2 that has been delivered to hook 48B by needle 54-2. Needle 54-2 may then be retracted to the left (direction 78) and another shed change performed using warp fiber positioning equipment 42. This process (and the processes of laterally moving needles 54-1 and 54-3) may be performed repeatedly, thereby forming fabric 56 with a cross-sectional profile of the type shown in FIG. 7. Chain stitches 80 and 82 may be formed respectively along the interface between upper horizontal warp fiber portion 40-1 and intermediate diagonal warp fiber portion 40-2A and along the interface between intermediate diagonal warp fiber portion 40-2B and lower horizontal warp fiber portion 40-3 to secure the weft fibers at these locations (e.g., using a monofilament chain stitch). Once weaving is complete and once the opposing ends of an appropriately sized length of fabric 56 have been joined at seam 40M, the fabric of case 20 may be stretched around the periphery of device 10, as shown in FIG. 2.

To accommodate rounded corners in device housing 12, case 20 may be provided with woven rounded corners 20E. The flat vertical portion of case 20 (i.e., vertical fabric sidewall 30) can bend around the corner. The horizontal portions of case 20 (e.g., upper and lower horizontal wall portions 28 and 32) are preferably woven in a way that helps accommodate the curved corner shape of device 10 and case 20.

Figure 8:
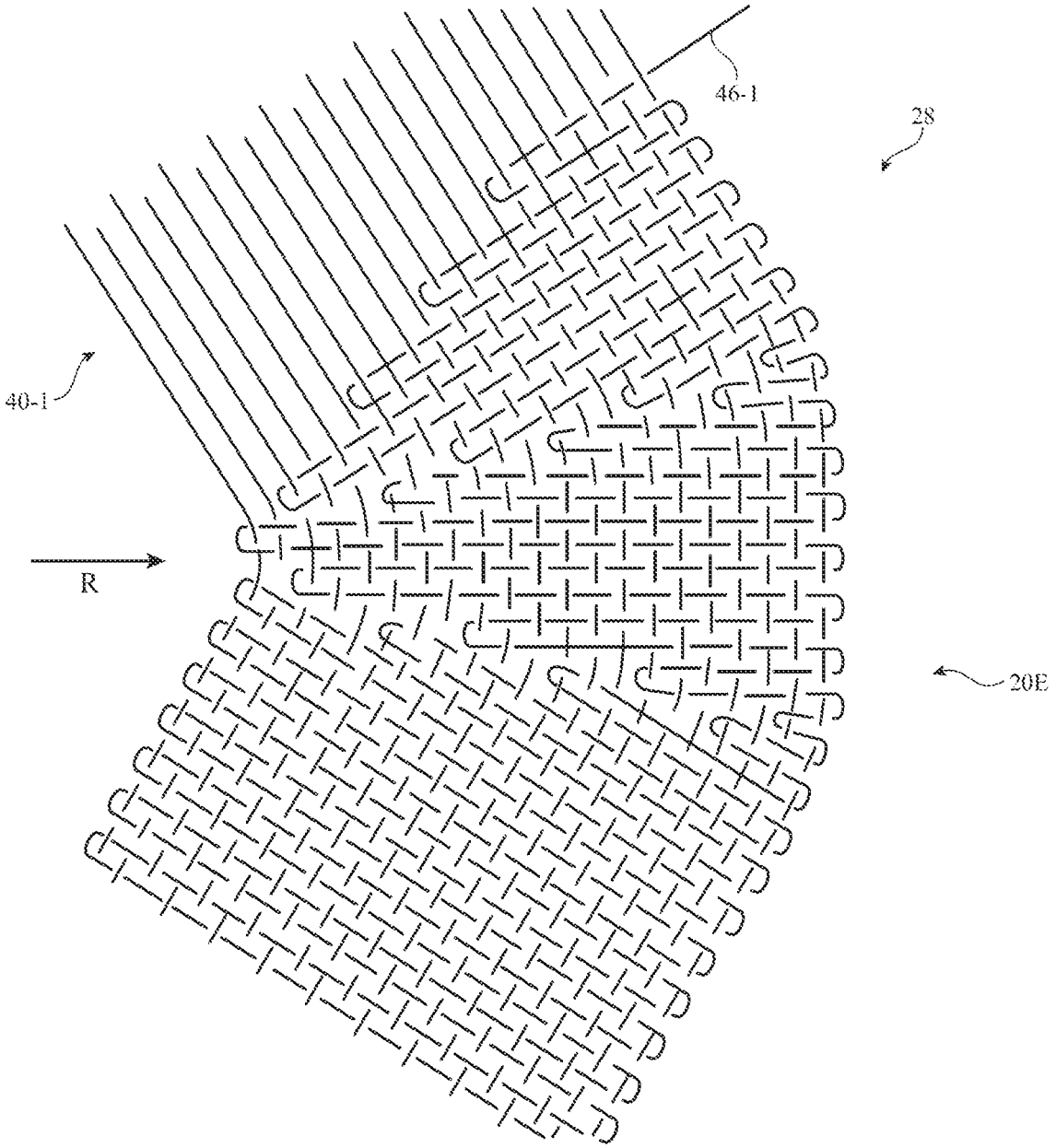
FIG. 8 is a top view of a corner portion of a woven fabric case in accordance with an embodiment.

FIG. 8 is a top view of upper horizontal warp fiber portion 40-1 along one of the corners 20E of case 20 during weaving. As corner 20E is formed, the amount of weft fiber 46-1 that is required to produce a flat fabric will vary as a function of radial position R. Portions of the fabric of corner 20E that are near the inner edge of corner 20E (i.e., smaller R values) will require fewer weft fibers than regions of the fabric that are nearer the outer edge of corner 20E (i.e. larger R values). This spatially varying need for weft fibers can be accommodated by incorporating short rows of weft fibers into the fabric, as shown in FIG. 8. Some rows of weft fiber 46-1 traverse all of upper horizontal warp fiber portion 40-1. In short rows, weft fiber 46-1 will only be incorporated within a smaller number of warp fibers in upper horizontal warp fiber portion 40-1. The selection of which warp fibers in upper horizontal warp fiber portion 40-1 are used to entrap weft fibers 46-1 (and therefore the resulting length of each weft fiber row in the fabric) may be made using warp fiber positioning equipment 42 (FIG. 6).

Figure 9:
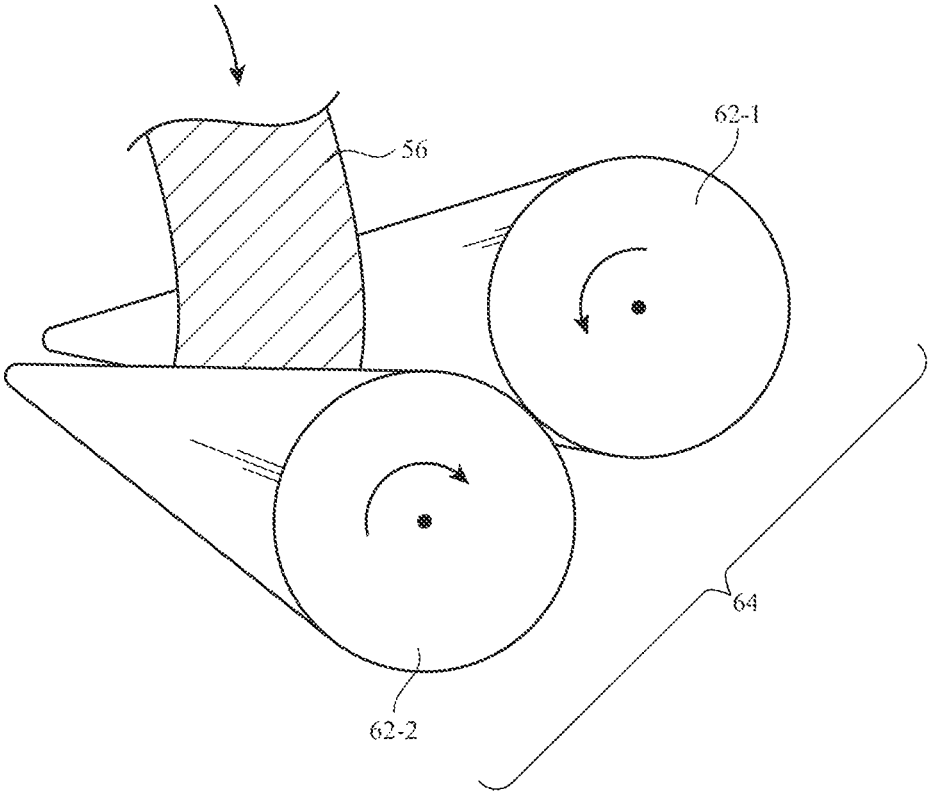
FIG. 9 is a perspective view of an illustrative take down system based on a pair of cone-shaped rollers in accordance with an embodiment.

The characteristics of fabric 56 (e.g., the number of picks per inch and the curvature of fabric 56) can be influenced by take down system 64. FIG. 9 shows an illustrative configuration for take down system 64 that is based on a pair of conical rollers 62-1 and 62-2. During weaving, woven fabric 56 is drawn between rollers 62-1 and 62-2 as shown in FIG. 9. The surfaces of rollers 62-1 and 62-2 may be covered with an abrasive material such as sandpaper to help grip the fibers of fabric 56. This tensions one edge of fabric 56 more than the other and creates a curve in the fabric that is being woven. When incorporating short rows into the weft, as described in connection with FIG. 8, the surface of the fabric that is formed in this wall may be smooth and uniform.

Some fabric structures (e.g., donut-shaped structures) may be created by continuously drawing fabric 56 through a take down system based on conical rollers of the type shown in FIG. 9. Other fabric structures (e.g., case 20 of FIG. 3) may have a combination of straight (non-curved) fabric segments and curved fabric segments (e.g., corners 20E). To produce fabric with a curvature that varies as a function of distance along its length, computer-controlled rollers of the type shown in FIG. 10 may be used.

Figure 10:
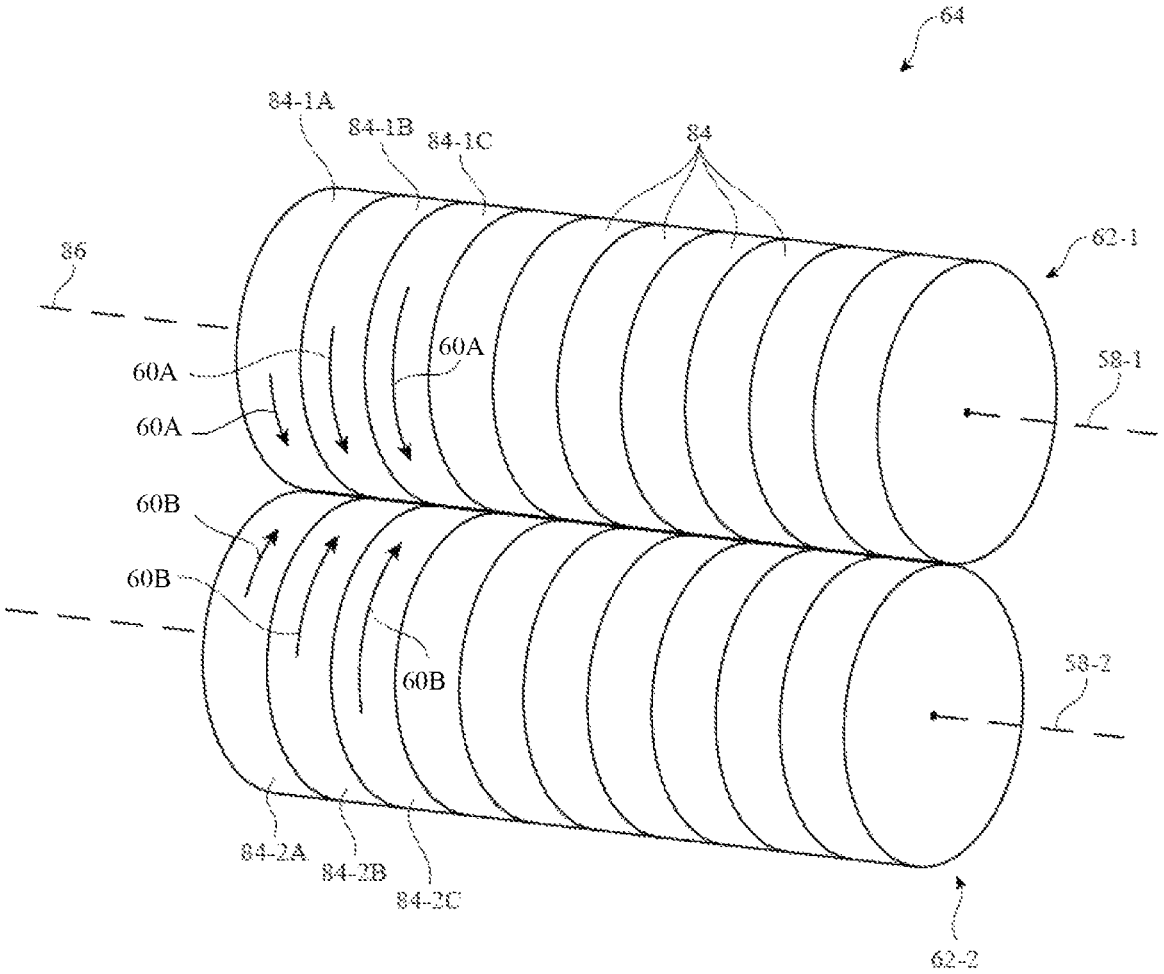
FIG. 10 is a perspective view of an illustrative take down system based on a pair of rollers each of which has a set of independently controlled rotating disks in accordance with an embodiment.

In illustrative take down system 64 of FIG. 10, rollers 62-1 and 62-2 rotate towards each other around respective rotational axes 58-1 and 58-2, respectively. Fabric 56 that is being woven with system 36 may be drawn between rollers 62-1 and 62-2. Each roller may have a series of independently controlled rotating disks 84.

When it is desired to form a straight length of fabric 56, all of the portions of fabric 56 may be tensioned equally by rotating all disks 84 in unison. In this mode of operation, rollers 62-1 and 62-2 act as disks 84 that are joined together.

When it is desired to form a curved section of fabric 56, the individual disks of each roller may be rotated at different speeds. For example, the speed of rotation of each disk may be increased with increasing distance along the rotational axis of the roller (along at least a portion of the roller) to replicate the tensioning effects produced by a set of conical rollers of FIG. 9. In the take down system of FIG. 9, opposing disks 84-1A and 84-2A may be rotated in directions 60A and 60B at a first speed. Opposing disks 84-1B and 84-2B, which are located farther along the rollers, may be rotated in directions 60A and 60B at a second speed that is greater than the first speed. Disks 84-1C and 84-2C may be rotated at a third speed that is greater than the second speed and so forth to produce a desired rotation speed profile across rollers 62-1 and 62-1. Controlling the individual disks 84 of rollers 62-1 and 62-2 in this way allows curved fabric for corners 20E of case 20 to be formed.

Figure 11:
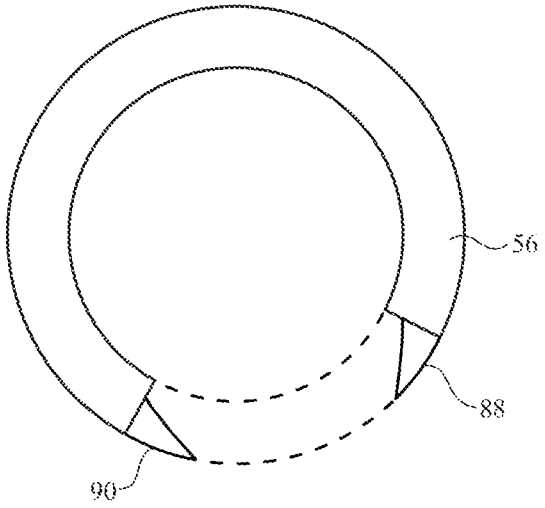
FIG. 11 is a perspective view of an illustrative donut-shaped fabric structure formed using a weaving system in accordance with an embodiment.

System 36 may, if desired, be used to form a donut-shaped fabric structure such as fabric 56 of FIG. 11. Fabric 56 of FIG. 11 may be formed, for example, using conical rollers 62-1 and 62-1 or rollers 62 with individually rotating disks 84 in take down system 64, as described in connection with FIGS. 9 and 10. When it is desired to form a completed fabric structure, a seam may be formed by joining ends 88 and 90. Foam or other materials may be placed in an interior donut-shaped cavity formed within the interior of fabric 56 of FIG. 11. The inner edge of the donut may then be joined together (e.g., the inner edges of fabric 56 may be joined using a circular seam that runs around the circular interior edge of the donut). Donut-shaped fabric structures may be used in headsets and other electronic device accessories (as an example).

Figure 12:
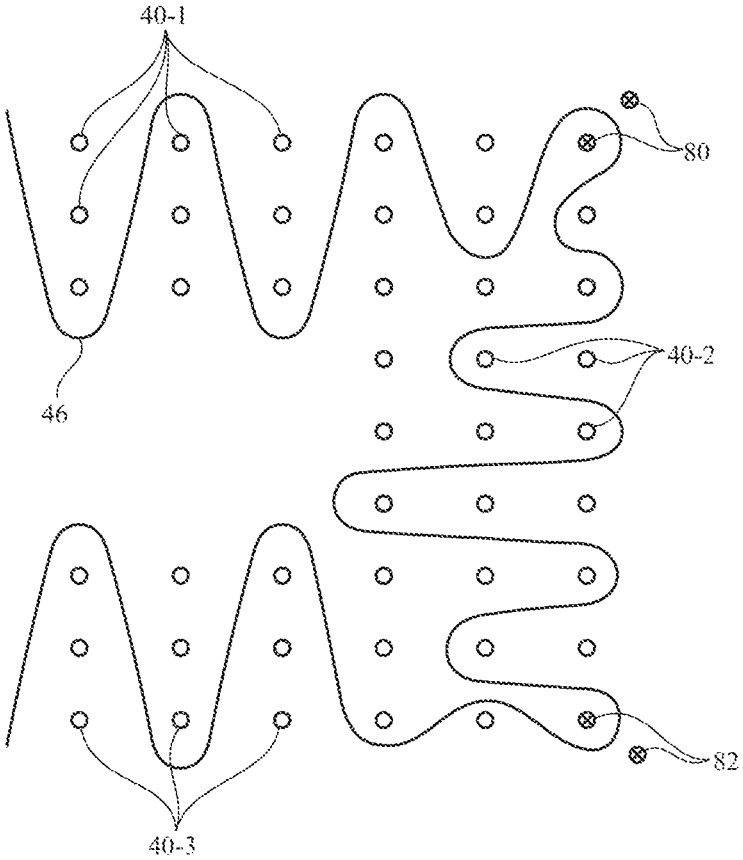
FIG. 12 is a cross-sectional side view of an edge portion of an illustrative fabric case in accordance with an embodiment.

As shown in FIG. 12, case 20 may be formed using multiple layers of warp fibers 40. In the example of FIG. 12, upper horizontal warp fiber portion 40-1 is three layers thick, warp fibers 40-2 are three layers wide, and lower horizontal warp fiber portion 40-3 is three layers thick. In general, the number of layers of warp fibers 40 that are stacked next to each other may be two or more, three or more, five or more 10 or more, 20 or more, 50 or more, less than 75, less than 15, or other suitable number. Weft fibers 46 may follow paths through varying numbers of warp fibers as shown in FIG. 12. Chain stitches 80 and 82 may be formed along the periphery of case 20 (e.g., along the upper peripheral edge of case 20 and along the lower peripheral edge of case 20 in a C-shaped case of the type shown in FIG. 3). The fabric of case 20 in the example of FIG. 12 may be formed using a needle weaving system such as system 36 of FIG. 6 or other suitable equipment.

In general, any suitable fabric structures may be produced using weaving system 36 of FIG. 6. The formation of a woven case such as case 20 and a donut-shaped structure such as the structure of FIG. 11 is merely illustrative.

The foregoing is merely illustrative and various modifications can be made by those skilled in the art without departing from the scope and spirit of the described embodiments. The foregoing embodiments may be implemented individually or in any combination.

What is claimed is:

1. A fabric case for an electronic device, comprising:

warp fibers and weft fibers;

four woven straight fabric segments that are formed with the warp fibers and weft fibers; and four woven curved corners that are formed with the warp fibers and weft fibers, wherein the four woven corners are formed between the four woven straight segments, wherein the woven straight fabric segments and the curved corners have a C-shaped profile, wherein the C-shaped profile has upper, lower, and side portions and wherein a weft fiber in the weft fibers extends through each of the upper, lower, and side portions.

2. The fabric case defined in claim 1 wherein the weft fibers form short rows in the corners.

3. The fabric case defined in claim 2 wherein the woven straight fabric segments include first, second, third, and fourth woven straight segments, wherein the first and second segments extend along a first dimension and the third and fourth segments extend along a second dimension.

4. The fabric case defined in claim 3 further comprising a planar rear wall coupled to the lower portion of the C-shaped profile.

5. The fabric case defined in claim 1 wherein the four woven corners each include an upper fabric portion with weft fibers that form short rows and a lower fabric portion with weft fibers that form short rows.

6. The fabric case defined in claim 5 wherein the four woven corners each include a sidewall fabric portion that extends from the upper fabric portion to the lower fabric portion.

7. The fabric case defined in claim 6 wherein the upper and lower fabric portions are parallel and wherein the sidewall fabric portion is perpendicular to the upper and lower fabric portions.

8. The fabric case defined in claim 1 wherein the four woven straight fabric segments and the four woven curved corners form a ring-shaped fabric structure having an upper planar portion, a lower planar portion that lies parallel to the upper planar portion, and a sidewall portion that extends from the upper planar portion to the lower planar portion.

9. A fabric case for an electronic device, comprising:
- a rear wall;
- a lower fabric portion;
- an upper fabric portion;
- four sidewalls coupled between the upper and the lower fabric portions, wherein the rear wall, the lower fabric portion, and the four sidewalls surround a cavity;
- four corners interspersed with the four sidewalls, wherein each of the four corners comprises:
  - warp fibers; and
  - first and second weft fibers, wherein the first weft fiber overlaps fewer warp fibers than the second weft fiber; and
- a seam, wherein the seam extends through the upper fabric portion, the lower fabric portion, and one of the four sidewalls.

10. The fabric case defined in claim 9 wherein each of the four corners comprises a third weft fiber that overlaps an equivalent number of warp fibers as the first weft fiber, and wherein the second weft fiber is interposed between the first and third weft fibers.

11. The fabric case defined in claim 9 wherein the rear wall comprises a layer of plastic.

12. The fabric case defined in claim 9 wherein the rear wall comprises woven fabric.

13. The fabric case defined in claim 9 wherein the rear wall comprises fabric that is integral with the four sidewalls.

14. A fabric case for an electronic device, comprising:
- first and second sidewalls;
- first and second opposing fabric ends, wherein the first and second opposing fabric ends are joined along a seam on the first sidewall;
- warp strands; and
- first, second, and third weft strands, wherein the second weft strand is located between the first and third weft strands, wherein the first and third weft strands overlap a first number of the warp strands, wherein the second weft strand overlaps a second number of the warp strands, and wherein the second number is greater than the first number.

15. The fabric case defined in claim 14 further comprising:
- first and second fabric segments that extend respectively along first and second perpendicular dimensions; and
- a corner fabric portion located between the first and second fabric segments, wherein the first, second, and third weft strands are located in the corner fabric portion.

16. The fabric case defined in claim 15 further comprising:
- a rear wall portion coupled to the first and second fabric segments.

17. The fabric case defined in claim 16 wherein the rear wall portion comprises woven fabric.

18. The fabric case defined in claim 15 wherein the corner fabric portion has a curved profile.

* * * * *